US007695153B2

(12) United States Patent
Tsai

(10) Patent No.: US 7,695,153 B2
(45) Date of Patent: Apr. 13, 2010

(54) UMBRELLA LIGHT WITH AUDIO MODULE

(76) Inventor: Sam Tsai, 10F, No. 47, JingAn Road, JhongHo, Taipei County (TW)

( * ) Notice: Subject to any disclaimer, the term of this patent is extended or adjusted under 35 U.S.C. 154(b) by 148 days.

(21) Appl. No.: 12/025,917

(22) Filed: Feb. 5, 2008

(65) Prior Publication Data

US 2009/0196020 A1 Aug. 6, 2009

(51) Int. Cl.
*A45B 3/02* (2006.01)

(52) U.S. Cl. ..... 362/102; 362/431; 135/16; 135/910

(58) Field of Classification Search ..... 362/102, 362/431, 86; 135/16, 910; 248/519, 523
See application file for complete search history.

(56) References Cited

U.S. PATENT DOCUMENTS 7,134,762 B2 11/2006 Ma
7,497,583 B2 * 3/2009 Ma ..... 362/102
2006/0249188 A1 * 11/2006 DeFouw et al. ..... 135/91
2007/0242450 A1 * 10/2007 Blatecky ..... 362/102
2009/0014041 A1 * 1/2009 Li ..... 135/16
2009/0090404 A1 * 4/2009 Kuelbs ..... 135/16

* cited by examiner

*Primary Examiner*—Stephen F Husar
*Assistant Examiner*—Peggy A. Neils
(74) *Attorney, Agent, or Firm*—Rabin & Berdo, P.C.

(57) ABSTRACT

The present invention is an umbrella light with an audio module, including a hosing, at least two fastener, at least two turned lights, an audio module and a control module. The fastener provides a better gripper structure with a torsional spring, and the audio module can be arranged with external audio source, which provides people with wonderful melody.

8 Claims, 7 Drawing Sheets

UMBRELLA LIGHT WITH AUDIO MODULE

FIELD OF THE INVENTION

The present invention relates to an umbrella light, and more particularly, to an umbrella light with audio module.

BACKGROUND OF THE INVENTION

It is quite usual to see people to use a garden umbrella in various outdoor resting/dining areas to shade sunlight or rain drops. Hence, the garden umbrella is good companion for entertaining, patios, decks, relaxing, and camping, to provide a comfortable and relaxing environment. But normally the lights in the garden are not specifically designed for use with the umbrella shielded; the brightness becomes dim after sunset. Thus, people have developed an illuminating apparatus rib-mounted on umbrella's post.

According to U.S. Pat. No. 7,134,762 B2 which is issued on Nov. 14, 2006, entitled "Light providing apparatus attachable to umbrella and stand assembly" disclosed an umbrella light. The umbrella light comprises a main body, and the main body is interconnected by two structurally base parts A and B. The base part A and the base part B is a chamber with a semicircular shape, and each having a semi-circularly concave at the noncurved inner sidewall, which facing of the other and forms a hole when the two base parts are joined together. On the one side of the base part A equipped with a pivotal stem fasten a pivotal hole which equipped on base part B, and the other side of base part A equipped a latch pin and latch to a latch hole in the base part B, and therefore the two base parts are connected together to rib around the umbrella post through the hole. Moreover, a stand gripper is mounted in the middle of a semi-circular concave opening of each base part A and base part B, the stand gripper consisted of a rod and a spring. By the bounce of the spring, the rod is against to the umbrella post and the umbrella light stands. Additionally, the light module disposed on both bottom side of base part A and base part B, thus, the illumination can be obtained.

SUMMARY OF THE INVENTION

It is not easy to meet the requirement of leisure time without audio/music effect; therefore, the primary objective of the present invention is to provide an umbrella light with audio module, comprising:

two base parts, is a chamber with semicircular shape, and each base part has a semi-circular concave opening at the noncurved inner sidewall and a groove at the curved outer sidewall, the two base parts opposing each other and forms a hole when two base parts joined together as a complete disc;

a housing, interconnected by two base parts;

at least two fasteners, disposed inside of the housing;

a plurality of pivotable lights, pivoted on the groove and allocated even on the both base parts to adjust the illumination projected away from the housing;

an audio module, disposed inside of the housing; and a control module, electrically connected to the audio module and the turned light.

Wherein the fastener disposed in middle of the semi-circularly concave, and fastener includes an L-form latch, a torsion spring and a curved spacer. The L-form latch structure with a fixed portion on the short edge and a pivotable portion on the end of long edge, the torsion spring operatively connected to the L-form latch inside the semi-circularly concave for resiliently biasing the pivotable portion toward the fixed portion.

Subsequently, the curve spacer is mounted on the fixed portion. Thus, the fixed portion with the curved spacer is against to the umbrella post.

The audio module includes a speaker, an audio receiver, a volume regulator and an amplifier. Operationally, the signal transmission of the audio source and the audio receiver, which is wireless transmission or wire transmission.

The control module includes a sensor and a controller. The controller is electrically connected to a switch and the volume regulator. With the sensor, the control module can remote operate audio volume and light wirelessly.

Accordingly, once the user mounted the umbrella light on the umbrella post, the umbrella post pushes the curved spacer, and the torsion spring is twisted by the curved spacer, subsequently the torsion spring resiliently biasing the L-form latch, the L-form latch shifted specific angle by thrusting. In the other word, the potential energy of the curved spacer results in the angular momentum of L-form latch. Therefore, the proper resiliently grip is imposed. Moreover, the audio module of the umbrella light can be arranged with external audio source, which provides the people with wonderful melody.

BRIEF DESCRIPTIONS OF THE DRAWINGS

The foregoing aspects, as well as many of the attendant advantages and features of this invention will become more apparent by reference to the following detailed description, when taken in conjunction with the accompanying drawings, wherein.

DETAILED DESCRIPTIONS OF THE PREFERRED EMBODIMENT

Figure 1:
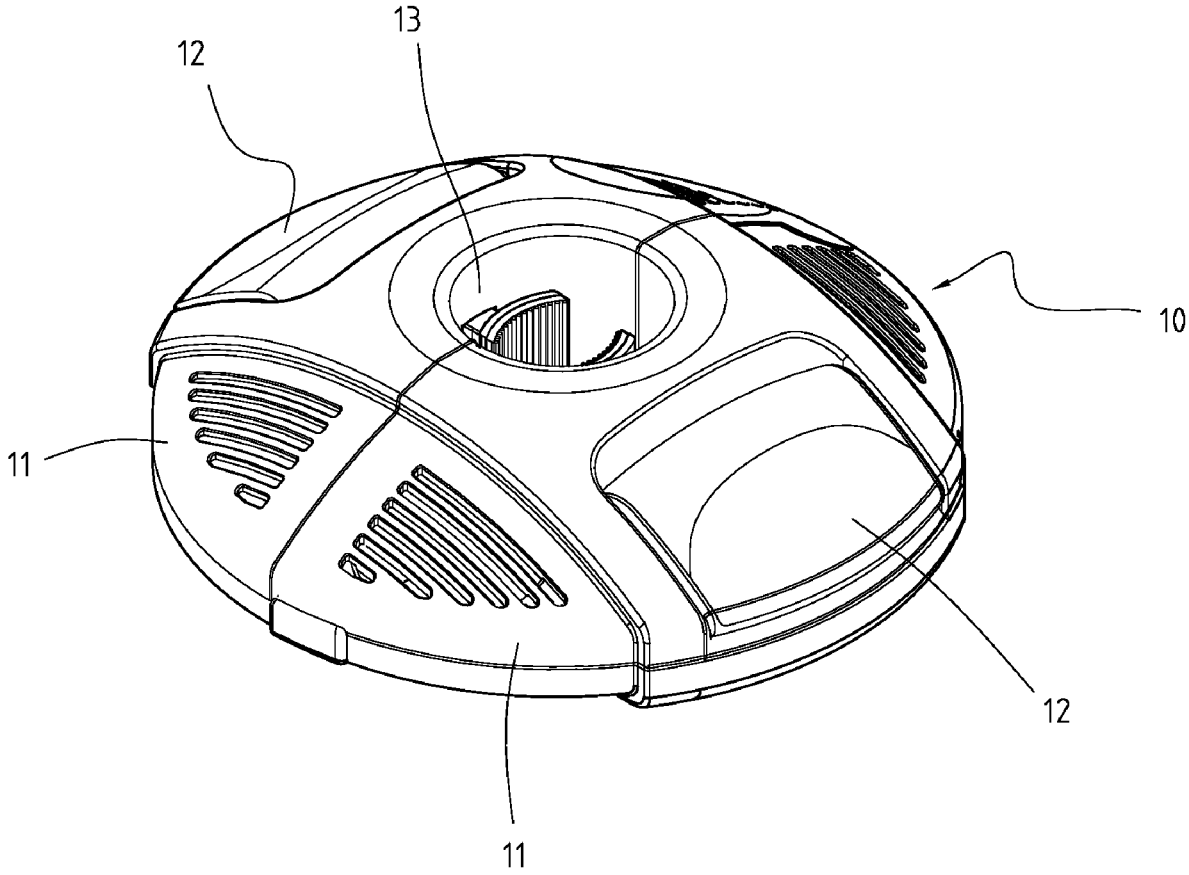
FIG. 1 illustrates the front elevational view of the present invention.
Figure 2:
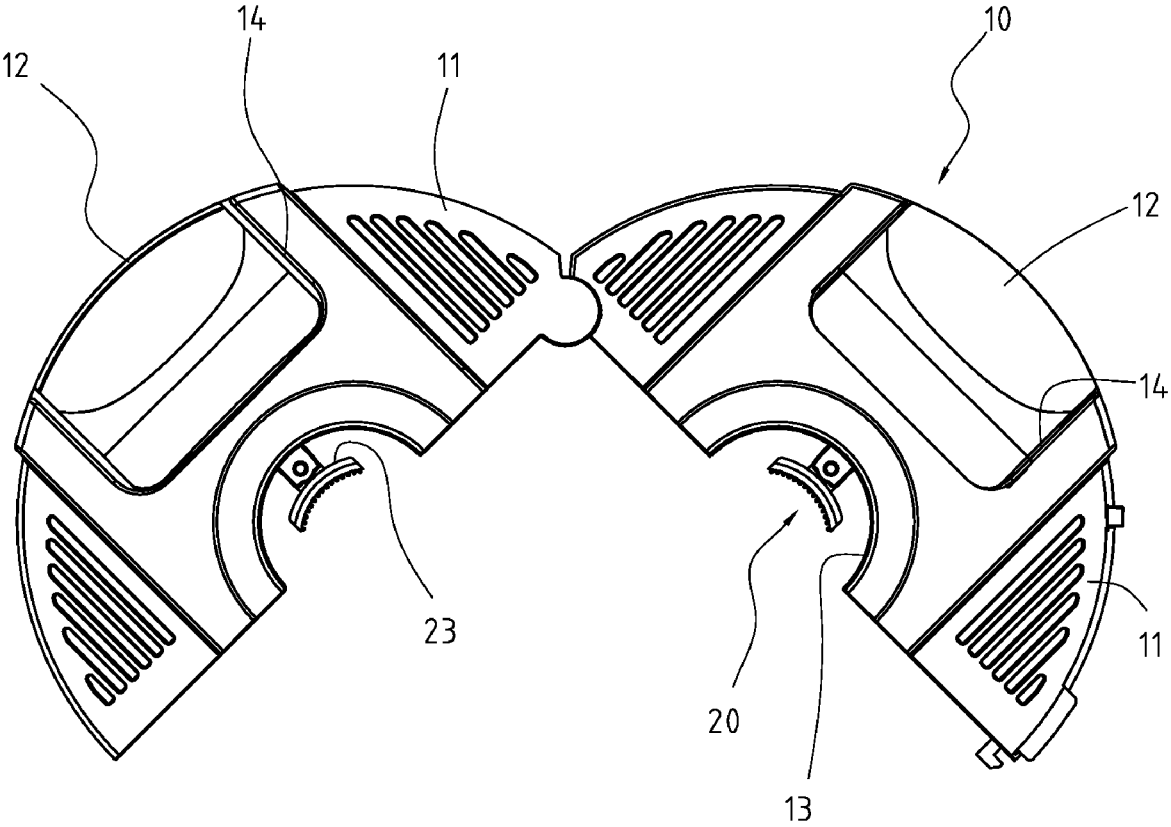
FIG. 2 illustrates the front elevational view at de-mounting state of the present invention.
Figure 3:
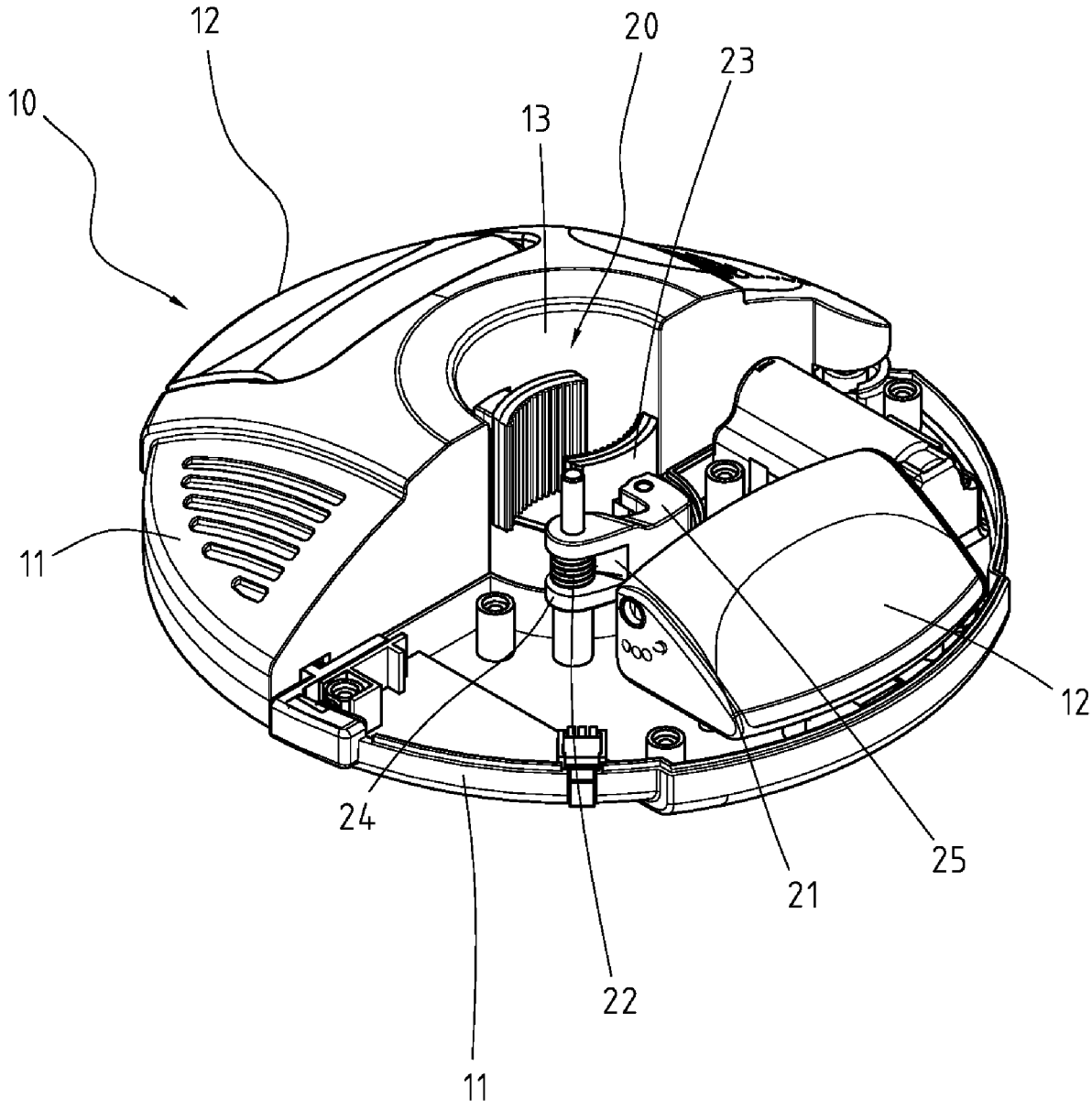
FIG. 3 illustrates the detailed portion cross sectional and broken view of the present invention.

With reference to FIGS. 1-3, illustrating an umbrella light with audio module of the present invention, comprising: two base parts (11), is a chamber with semicircular shape, and each base part (11) has a semi-circular concave opening (13) at the noncurved inner sidewall and a groove (14) at the curved outer sidewall, the two base parts (11) opposing each other and forms a hole when two base parts (11) joined together as a complete disc; a housing (10), interconnected by two base parts (11); at least two fasteners (20) disposed inside of the housing (10), which is a gripper, includes an L-form latch (21) structure with a mounting portion (25) on the short edge and a pivotable portion (24) on the end of long edge, a torsion spring (22) and a curved spacer (23); a plurality of pivotable lights (12), pivoted on the groove (14) and allocated even on the both base parts (11) to adjust the illumination projected away from the housing (10).

Figure 4:
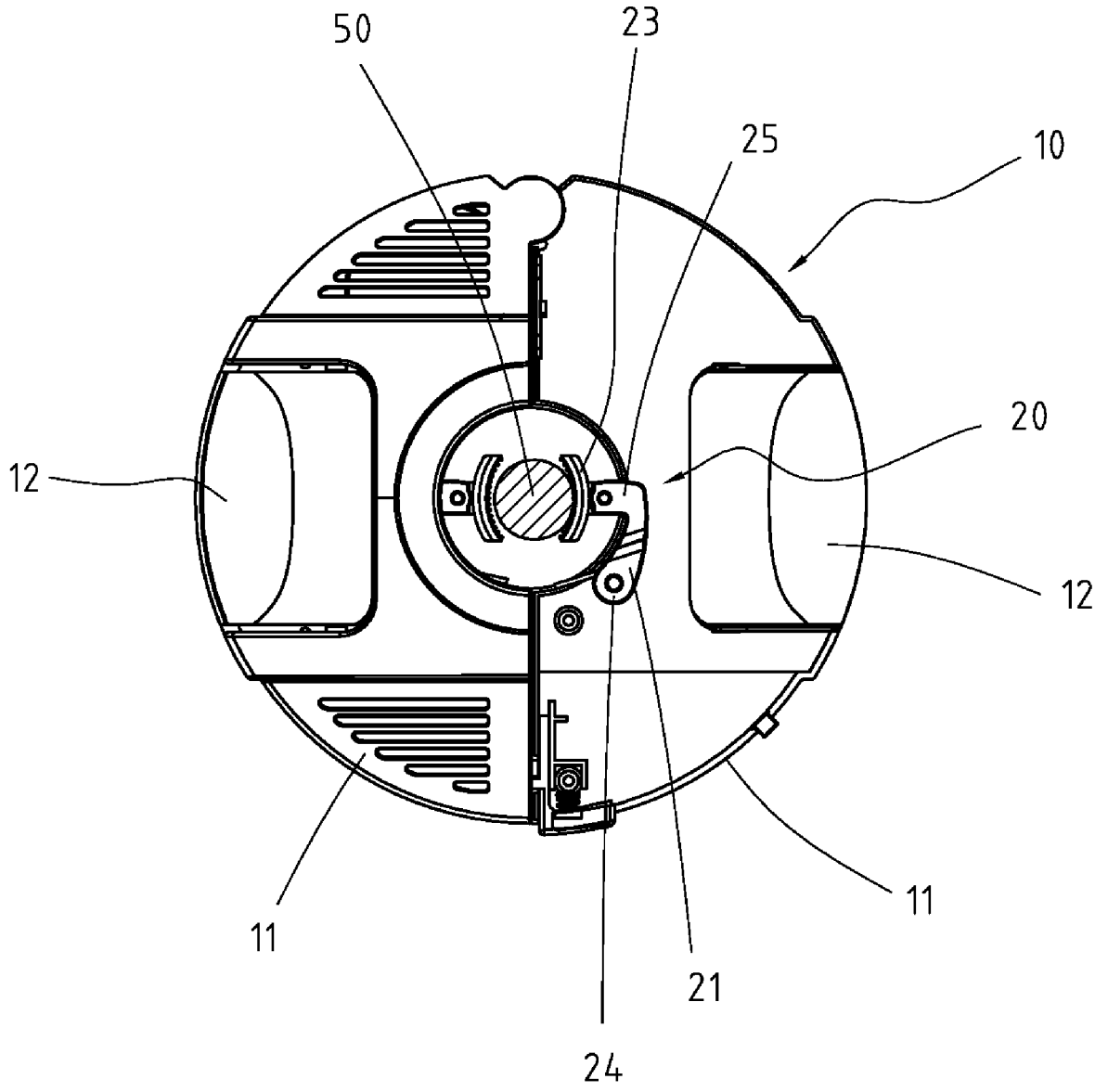
FIG. 4 illustrates the top view and detailed portion cross sectional view of the present invention stands thinner umbrella post.

Next, referring to FIG. 3 and FIG. 4, at least two fasteners (20) mounted inside the housing (10), especially disposed in middle of the semi-circular concave opening (13), the fastener (20), which is a gripper, includes an L-form latch (21), a torsion spring (22) and a curved spacer (23). The L-form latch (21) structure with a mounting portion (25) on the short edge and a pivotable portion (24) on the end of long edge, the torsion spring (22) operatively connected to the L-form latch (21) inside the semi-circularly concave (13) for resiliently biasing the pivotable portion (24) toward the mounting portion (25). Subsequently, the curved spacer (23) is mounts the mounting portion (25). Thus, the mounting portion (25) with the curved spacer (23) is disposed in contact with the umbrella post (50).

Figure 5:
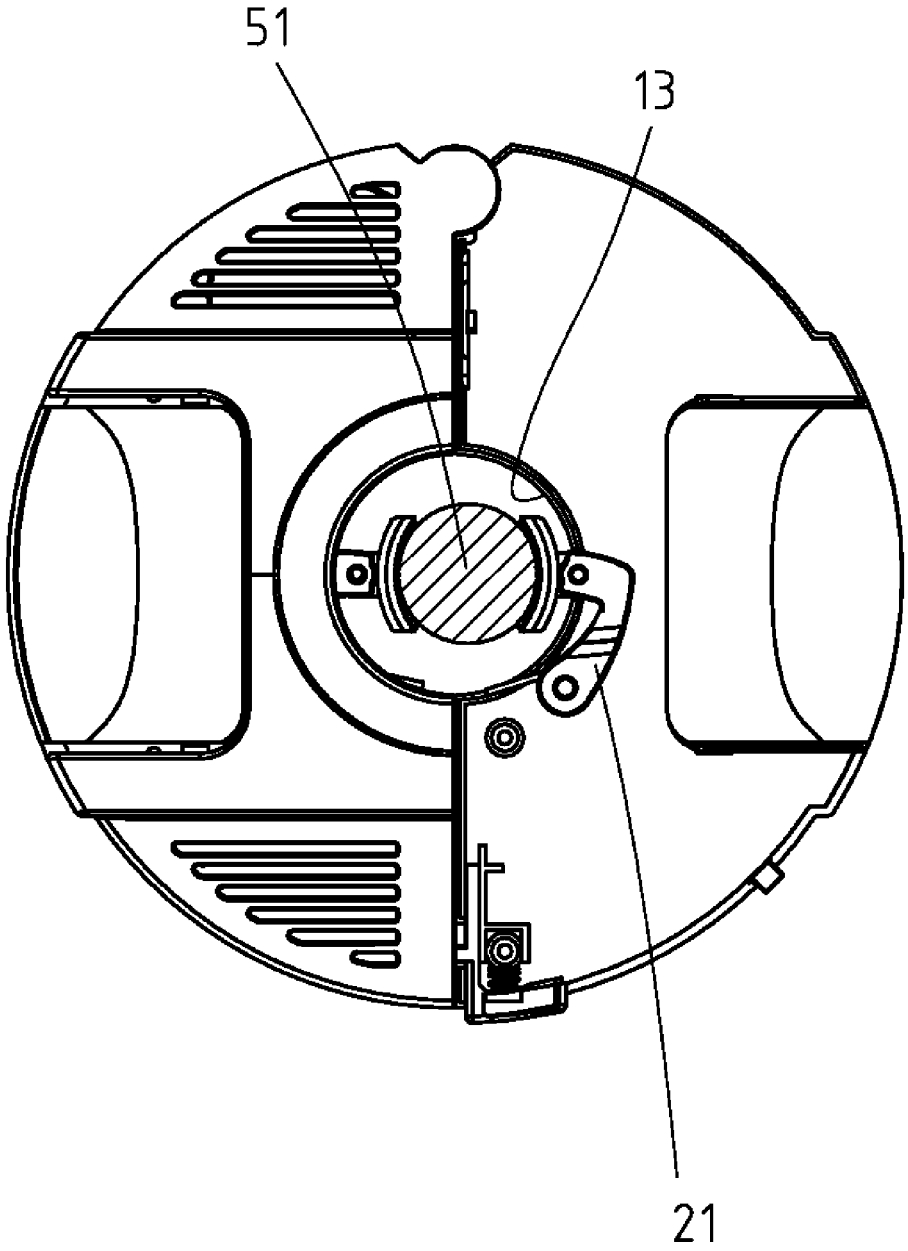
FIG. 5 illustrates the top view and detailed portion cross sectional view of the present invention stands thicker umbrella post.

In FIG. 4 and FIG. 5, the different thickness of the umbrella post (50,51) leads to a change of displacement of the L-form latch (21), the L-form latch (21) and the semi-circular concave opening (13) to a specific angle by thrusting from the umbrella post (50,51). In the other word, the angular momentum of L-form latch (21) made the spring corresponding to the multiform thickness of umbrella post and provides proper grip to umbrella post (50,51).

Figure 6:
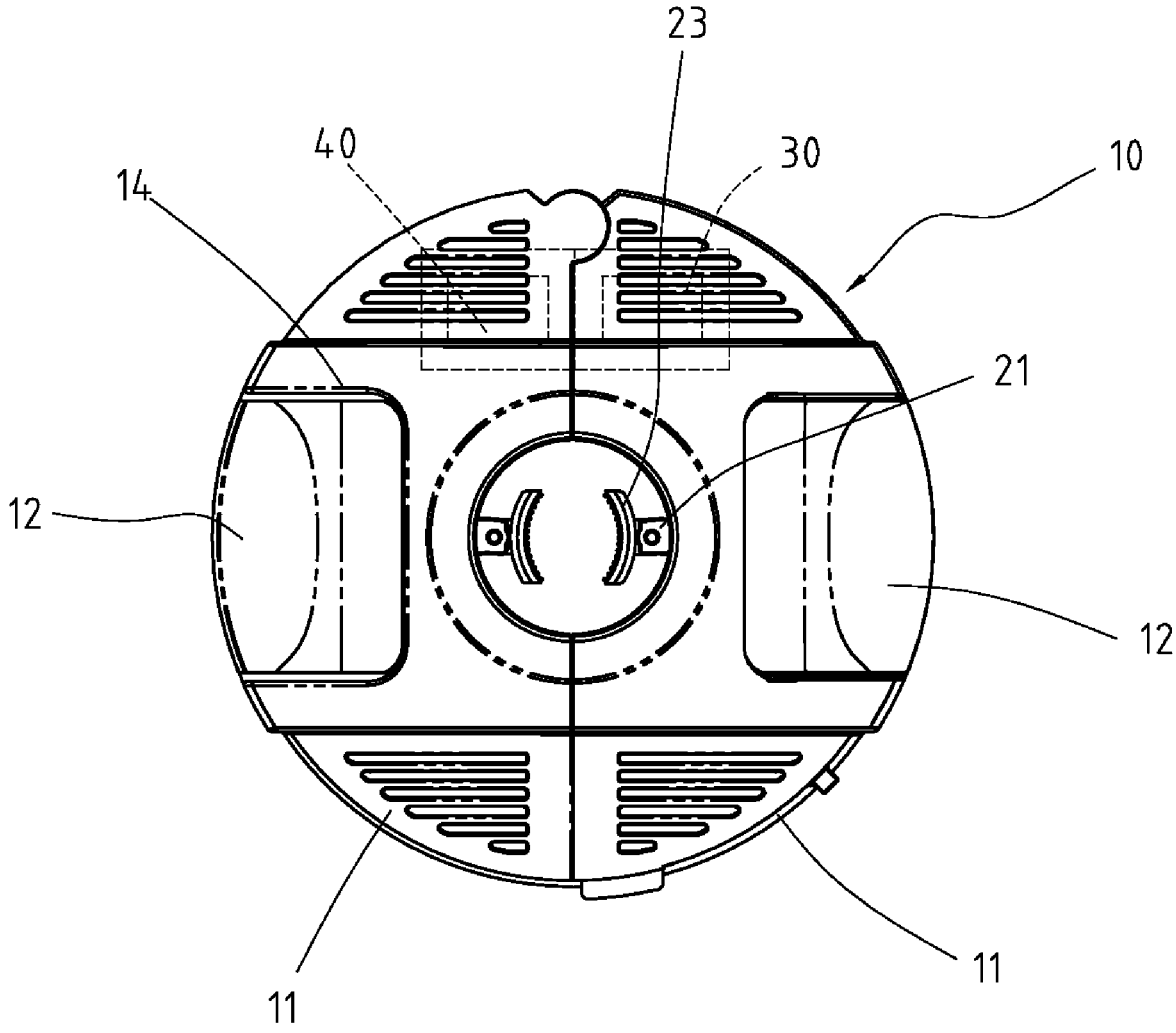
FIG. 6 is a perspective diagram illustrates the disposition of the audio module and control module.
Figure 7:
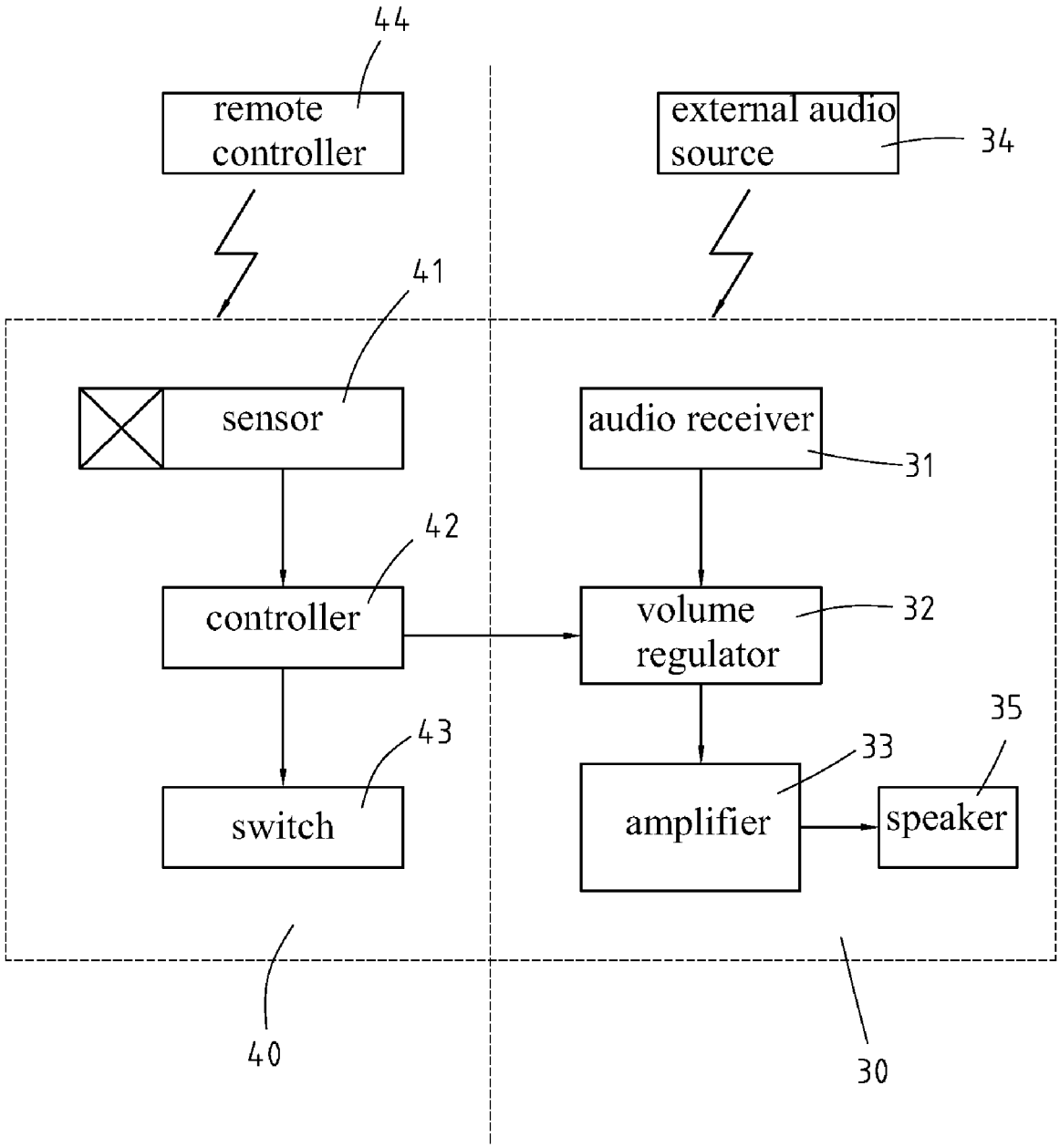
FIG. 7 is a block diagram illustrates the audio module and control module of the present invention.

With reference to FIG. 6 and FIG. 7, illustrating the audio module (30) and control module (40), the control module (40) is electrically connected to the audio module (30) disposed inside the housing in the umbrella light (10), and the control module (40) includes a sensor (41) and a controller (42). The controller (42) is electrically connected to a switch (43) and a volume regulator (32). Moreover, the umbrella light further comprises the audio module (30). The audio module (30) includes a speaker (35), an audio receiver (31), a volume regulator (32) and an amplifier (33). The audio receiver (31) can receive any type of transmission signal input, for example, the wireless transfers. Combined with the sensor (41), which can receive a signal from a remote controller (44), the control module (40) can remote operate audio volume wirelessly by a remote controller (44). Thus, the audio module (30) of the umbrella light can be arranged with external audio source (34), to improve people leisure time outdoor with light and audio provided.

While the invention has been particularly shown and described with reference to the preferred embodiments thereof, these are, of course, merely examples to help clarify the invention and are not intended to limit the invention. It will be understood by those skilled in the art that various changes, modifications, and alterations in form and details may be made therein without departing from the spirit and scope of the invention, as disposed forth in the following claims.

What is claimed is:

1. A umbrella light with audio module, comprises:

two base parts, together forming a housing with a circular shape, each of the base parts having a semi-circular concave opening at a center of an inner sidewall thereof and a curved outer sidewall having a groove thereon, the base parts opposing each other and forming a hole when the base parts are joined together as a complete disc;

at least two fasteners, each being disposed inside a respective one of the of the base parts, each of the fasteners including an L-form latch, a torsion spring and a curved spacer, the L-form latch including a pivotable portion and a mounting portion, the pivotable portion of the L-form latch being connected to the torsion spring at the mounting portion;

a plurality of pivotable lights, each of the pivotable lights pivotably disposed on a respective one of the grooves of each of the base parts to adjust illumination projected from the housing;

an audio module, disposed inside of the housing; and a control module, electrically connected to the audio module.

2. The umbrella light of claim 1, wherein the audio module includes at least one speaker, an audio receiver, a volume regulator and an amplifier.

3. The umbrella light of claim 2, wherein the audio receiver further comprises a wireless receiver and a connector.

4. The umbrella light of claim 1, wherein the control module includes a sensor, a switch and a controller.

5. The umbrella light of claim 1, wherein the fastener is mounted in the semi-circular concave opening of the housing.

6. The umbrella light of claim 1, wherein the curved spacer is mounted to the mounting portion.

7. The umbrella light of claim 1, wherein the L-form latch is resiliently biased by the torsion spring.

8. The umbrella light of claim 6, wherein the curved spacer is disposed in contact with an umbrella post.

* * * * *